US011798472B1

(12) United States Patent
Ning et al.

(10) Patent No.: US 11,798,472 B1
(45) Date of Patent: Oct. 24, 2023

(54) PIXEL CIRCUIT, DISPLAY PANEL, AND DISPLAY DEVICE

(71) Applicant: HKC CORPORATION LIMITED, Guangdong (CN)

(72) Inventors: Xueqiang Ning, Guangdong (CN); Jianlei Li, Guangdong (CN); Peidi Huang, Guangdong (CN); Jie Chen, Guangdong (CN); Kelin Li, Guangdong (CN); Tao Gu, Guangdong (CN); Haijiang Yuan, Guangdong (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 18/335,005

(22) Filed: Jun. 14, 2023

(30) Foreign Application Priority Data

Sep. 20, 2022 (CN) ..... 202211145865.8

(51) Int. Cl.
*G09G 3/3225* (2016.01)

(52) U.S. Cl.
CPC ... *G09G 3/3225* (2013.01); *G09G 2300/0842* (2013.01); *G09G 2310/08* (2013.01); *G09G 2320/0257* (2013.01); *G09G 2320/046* (2013.01)

(58) Field of Classification Search
CPC ..... G09G 3/3225; G09G 2300/0842; G09G 2320/0257; G09G 2320/046
See application file for complete search history.

(56) References Cited

U.S. PATENT DOCUMENTS

| | | | | |
|---|---|---|---|---|
| 10,693,461 | B1 | 6/2020 | Chang | |
| 2004/0104686 | A1 | 6/2004 | Shin et al. | |
| 2008/0136487 | A1 | 6/2008 | Chen et al. | |
| 2017/0193918 | A1* | 7/2017 | Bae | G09G 3/3291 |
| 2019/0003668 | A1* | 1/2019 | Chun | G09F 9/33 |
| 2019/0066583 | A1 | 2/2019 | Chang et al. | |
| 2019/0080660 | A1 | 3/2019 | Kim et al. | |
| 2020/0013766 | A1* | 1/2020 | Kim | H01L 25/167 |

FOREIGN PATENT DOCUMENTS

| | | | |
|---|---|---|---|
| CN | 101135791 | A | 3/2008 |
| CN | 103325340 | A | 9/2013 |
| CN | 203520830 | U | 4/2014 |
| CN | 203858847 | U | 10/2014 |
| CN | 104332171 | A | 2/2015 |
| CN | 105609069 | A | 5/2016 |

(Continued)

OTHER PUBLICATIONS

The first office action issued in corresponding CN application No. 202211145865.8 dated Nov. 1, 2022.

(Continued)

*Primary Examiner* — Matthew A Eason
*Assistant Examiner* — Sujit Shah
(74) *Attorney, Agent, or Firm* — HAUPTMAN HAM, LLP

(57) ABSTRACT

Provided is a pixel circuit, a display panel, and a display device. The pixel circuit includes a light-emitting unit, a drive unit, and a control unit. A first light-emitting element and a second light-emitting element of the light-emitting unit are electrically connected with the control unit simultaneously. The drive unit is configured to send a data signal to the light-emitting unit to drive the same to emit light.

12 Claims, 9 Drawing Sheets

(56) References Cited

FOREIGN PATENT DOCUMENTS

| | | | |
|---|---|---|---|
| CN | 106415706 | A | 2/2017 |
| CN | 102456315 | A | 1/2018 |
| CN | 107644948 | A | 1/2018 |
| CN | 107945741 | A | 4/2018 |
| CN | 108877645 | A | 11/2018 |
| CN | 108922476 | A | 11/2018 |
| CN | 109272932 | A | 1/2019 |
| CN | 110062944 | A | 7/2019 |
| CN | 110264953 | A | 9/2019 |
| CN | 110264956 | A | 9/2019 |
| CN | 110459164 | A | 11/2019 |
| CN | 111402782 | A | 7/2020 |
| CN | 113450696 | A | 9/2021 |
| CN | 114898712 | A | 8/2022 |
| JP | 2000244298 | A | 9/2000 |
| JP | 2014049889 | A | 3/2014 |
| WO | 2021095602 | A1 | 5/2021 |

OTHER PUBLICATIONS

Notice of allowance issued in corresponding CN application No. 202211145865.8 dated Nov. 28, 2022.

WIPO, International Search Report and Written Opinion for International Application No. PCT/CN2023/095018, dated Jun. 25, 2023.

* cited by examiner

| | ADDRESS SEGMENT |
|---|---|
| CONTROL UNIT 1 | 0001 |
| CONTROL UNIT 2 | 0010 |
| CONTROL UNIT 3 | 0011 |
| CONTROL UNIT 4 | 0100 |
| CONTROL UNIT 5 | 0101 |
| CONTROL UNIT 6 | 0110 |
| CONTROL UNIT 7 | 0111 |
| CONTROL UNIT 8 | 1001 |
| CONTROL UNIT 9 | 1010 |

FIG. 10

PIXEL CIRCUIT, DISPLAY PANEL, AND DISPLAY DEVICE

CROSS REFERENCE TO RELATED APPLICATION(S)

This application claims priority to and the benefit of Chinese Application No. 202211145865.8, filed Sep. 20, 2022, the entire disclosure of which is hereby incorporated by reference.

TECHNICAL FIELD

This disclosure relates to the field of display technology, and particularly relates to a pixel circuit, a display panel having the pixel circuit, and a display device having the display panel.

BACKGROUND

With the development of display technology, market demands for display effect and taste of display devices are gradually increasing. In the market, an Organic Light-Emitting Diode (OLED) display screen generally adopts a direct-current driving mode. However, in the direct current driving mode, the OLED accumulates residual un-recombined carriers at an interface between a hole transport layer and a light-emitting layer or at an interface between the light-emitting layer and an electron transport layer. After the residual un-recombined carriers accumulates to a certain degree, a built-in electric field is formed inside. However, the formed built-in electric field may cause difficulty in injection of carriers in the next cycle, and further cause reduction of the recombination rate, thereby affecting the display quality and the service life of the OLED display screen.

SUMMARY

In a first aspect of the disclosure, a pixel circuit is provided. The pixel circuit, includes light-emitting unit and a drive unit, the pixel circuit further includes a control unit, where the light-emitting unit includes a first light-emitting element and a second light-emitting element, and the first light-emitting element and the second light-emitting element are electrically connected to the drive unit and the control unit; the drive unit is configured to transmit to the light-emitting unit a data signal for driving the first light-emitting element and/or the second light-emitting element to emit light.

The control unit includes a conduction selection unit, a conduction control unit, and a switch unit, the conduction control unit is electrically connected to both the conduction selection unit and the switch unit, and the switch unit is electrically connected to the first light-emitting element and the second light-emitting element.

The conduction selection unit includes a first selection transistor, a second selection transistor, a third selection transistor, and a fourth selection transistor, the first selection transistor is configured to receive a first signal and a power supply control signal, the first selection transistor is electrically connected to the third selection transistor and the conduction control unit, the second selection transistor is configured to receive an inverted signal of the first signal and the power supply control signal, the second selection transistor is electrically connected to the fourth selection transistor and the conduction control unit, the third selection transistor and the fourth selection transistor are electrically connected to a first power supply, and the conduction selection unit is configured to selectively control the conduction control unit to be in a first conductive state or a second conductive state according to the first signal received.

The light-emitting unit is configured to receive the data signal, the switch unit is configured to receive a second signal and control, according to a conductive state of the conduction selection unit and a potential of the second signal, the first light-emitting element and/or the second light-emitting element to be electrically connected to the first power supply, to cause the first light-emitting element and/or the second light-emitting element to emit light.

The switch unit is further configured to control, according to the conductive state of the conduction selection unit and the potential of the second signal, the first light-emitting element and/or the second light-emitting element to be electrically connected to a second power supply, to discharge charges accumulated in the first light-emitting element and/or the second light-emitting element.

In a second aspect of the disclosure, a display panel is provided. The display panel includes several pixel circuits described above.

In a third aspect of the disclosure, a display device is provided. The display device includes the display panel described above.

BRIEF DESCRIPTION OF THE DRAWINGS

FIG. 10 shows addresses corresponding to each control unit in the display panel shown in FIG. 8.

DESCRIPTION OF REFERENCE NUMERALS

Figure 1:
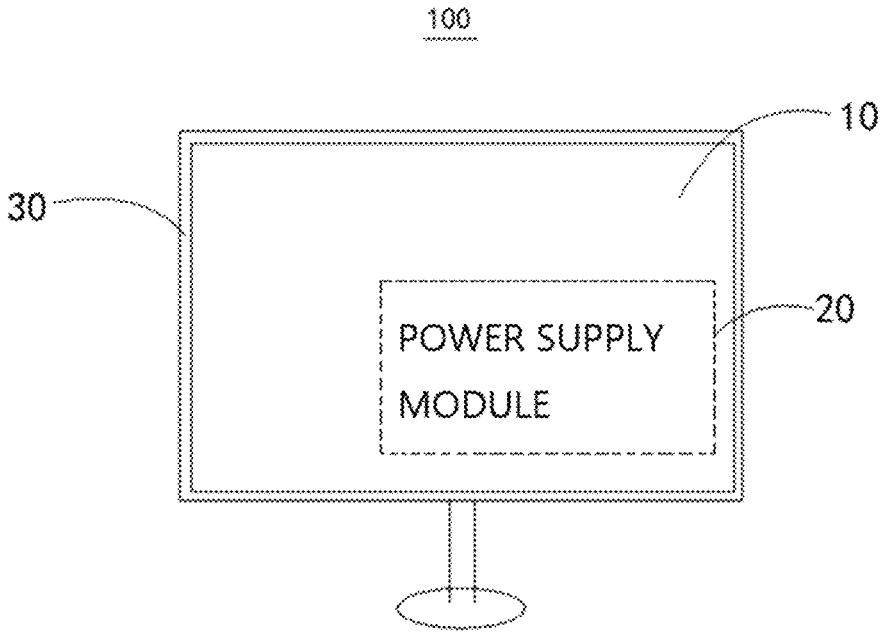
FIG. 1 is a schematic structural diagram of a display device disclosed in an embodiment of the disclosure.

100—display device; 1, 10—display panel; 15—pixel unit; 18—general control unit; 20—power supply module; 30—support frame; 11—display area; 13—non-display area; 40—pixel circuit; 152—first sub-pixel; 154—second sub-pixel; 156—third sub-pixel; 50—control unit; 60—light-emitting unit; 70—drive unit; 71—first transistor; 73—second transistor; 75—storage capacitor; 51—conduction selection unit; 53—conduction control unit; 55—switch unit; 511—first selection transistor; 513—second selection transistor; 515—third selection transistor; 517—fourth selection transistor; 531—first conductive transistor; 533—second conductive transistor; 551—first discharge transistor; 552—second discharge transistor; 554—third discharge transistor; 556—fourth discharge transistor; 553—second switch transistor; 555—first switch transistor; A—first light-emitting element; B—second light-emitting element; ELVSS—first power supply; ELVDD—second power supply; Data—data signal; Scan—scan signal; VDD—power supply signal; VDD1—power supply control signal; F1—first direction; F2—second direction; ab—first signal; BA—inverted signal; sw—second signal

DETAILED DESCRIPTION

In order to facilitate understanding of the disclosure, the disclosure will be described more fully hereinafter with reference to the accompanying drawings. Preferred embodiments of the disclosure are shown in the drawings, but the disclosure may be implemented in many different forms and is not limited to the embodiments described herein. Rather, these embodiments are provided so that this disclosure will be thorough and complete.

The following description of the embodiments refers to the accompanying drawings to illustrate specific embodiments of the disclosure. Sequential reference themselves, such as "first", "second", etc., are used merely to distinguish between described objects and do not have any ordinal or technical meaning. However, the expressions "connected" and "coupled" in the disclosure, unless otherwise specified, both include direct connection and indirect connection. Directional terms mentioned in the disclosure, for example, "upper", "lower", "front", "rear", "left", "right", "inner", "outer", "side" and the like are only directions with reference to the accompanying drawings, and therefore, the directional terms are used for better and clearer illustration and understanding of the disclosure, rather than indicate or imply that the indicated device or element must have a particular orientation, be constructed and operated in a particular orientation, therefore, it cannot be understood that the disclosure is limited thereto.

In the description of the disclosure, it should be noted that, unless specified or limited otherwise, the terms "mounted", "connected with", and "connected to" should be understood broadly, for example, may be fixedly connected, may also be detachably connected, or may be integrally connected; may also be mechanical connections; may also be direct connections or indirect connections via intervening structures; and may also be inner communications of two elements. The specific meanings of the above terms in the disclosure can be understood by those skilled in the art according to specific situations. It should be noted that terms such as "first" and "second" in the description and claims and drawings of the disclosure are used for distinguishing different objects, rather than for describing a specific sequence.

In addition, as used herein, the term "include", "may include", "contain" or "may contain" indicates the existence of a corresponding disclosed function, operation, element, etc., and does not exclude one or more other functions, operations, elements, etc. In addition, the terms "comprise" or "include" means that there are corresponding features, numbers, steps, operations, elements, components, or a combination thereof disclosed in the specification, and do not exclude the presence or addition of one or more other features, numbers, steps, operations, elements, components, or a combination thereof, and are intended to cover a non-exclusive inclusion.

It should also be understood that the meaning of "at least one" described herein is one and more than one, e. g., one, two, or three, etc., and the meaning of "a plurality of" or "multiple" is at least two, e. g., two or three, etc., unless specifically defined otherwise. The terms "step 1", "step 2", and the like in the description and claims of the disclosure and the drawings are used for distinguishing different objects, rather than for describing a specific order.

In view of the shortcomings of the prior art, an object of the disclosure is to provide a pixel circuit, a display panel, and a display device. A first light-emitting element and a second light-emitting element are arranged in a pixel circuit. A control unit selectively controls the first light-emitting element and/or the second light-emitting element to emit light, and at the same time, the control unit controls the first light-emitting element or the second light-emitting element to receive a second cathode voltage, so that electric charges ("charges" for short) accumulated therein are released when the first light-emitting element or the second light-emitting element does not emit light, thereby further prolonging the service life of the light-emitting unit, reducing the risk of screen burning, and improving the display taste.

In some embodiments, the drive unit includes a first transistor, a second transistor, and a storage capacitor, one end of the storage capacitor is electrically connected to a second end of the first transistor, and another end of the storage capacitor is electrically connected to a first end of the second transistor; a control end of the first transistor is configured to receive a scan signal, a first end of the first transistor is configured to receive the data signal, and a second end of the first transistor is electrically connected to a control end of the second transistor. A first end of the second transistor is configured to receive a power supply signal, and a second end of the second transistor is electrically connected to the light-emitting unit. The first transistor is configured to selectively transmit the data signal to the second transistor according to a potential of the scan signal received, and the second transistor is configured to selectively transmit the power supply signal to the light-emitting unit according to the data signal received.

In some embodiments, when the scan signal received by the first transistor is at a first potential, the first end of the first transistor and the second end of the first transistor are electrically disconnected; when the scan signal received by the first transistor is at a second potential, the first end of the first transistor and the second end of the first transistor are electrically conducted, and the data signal is transmitted to the second transistor. When the data signal received by the second transistor is at the first potential, the first end of the second transistor and the second end of the second transistor are electrically disconnected; when the data signal received by the second transistor is at the second potential, the first end of the second transistor and the second end of the second transistor are electrically conducted, and the power supply signal is transmitted to the light-emitting unit.

In some embodiments, a first end of the first light-emitting element and a first end of the second light-emitting element are electrically connected to the second end of the second transistor, and both a second end of the first light-emitting element and a second end of the second light-emitting element are electrically connected to the control unit. The control unit is configured to receive a first signal and a second signal, and controls, according to the potentials of the first signal and the second signal, the second end of the first light-emitting element and/or the second end of the second light-emitting element to be electrically connected to the first power supply.

In some embodiments, the control unit is further configured to control the second end of the first light-emitting element or the second end of the second light-emitting element to be electrically connected to a second power supply, so that the first light-emitting element or the second light-emitting element releases charges accumulated therein.

In some embodiments, when the first signal received by the control unit is at a first potential and the second signal is at the first potential, the second end of the first light-emitting element is electrically connected to the first power supply, and is configured to receive a first cathode voltage from the first power supply, where the first light-emitting element is configured to emit light, and the second end of the second light-emitting element is electrically connected to the second power supply and configured to receive a second cathode voltage from the second power supply.

When the first signal received by the control unit is at a second potential and the second signal is at the first potential, the second end of the second light-emitting element is electrically connected to the first power supply, and is configured to receive the first cathode voltage from the first power supply, the second light-emitting element is configured to emit light, and the second end of the first light-emitting element is electrically connected to the second power supply and configured to receive the second cathode voltage from the second power supply.

When the second signal received by the control unit is at the second potential, the second end of the first light-emitting element and the second end of the second light-emitting element are electrically connected to the first power supply and are configured to receive the first cathode voltage from the first power supply, and the first light-emitting element and the second light-emitting element are both configured to emit light.

In some embodiments, the control unit includes a conduction selection unit, a conduction control unit, and a switch unit, the conduction control unit is electrically connected to both the conduction selection unit and the switch unit, and the switch unit is electrically connected to the second end of the first light-emitting element and the second end of the second light-emitting element. The conduction selection unit is configured to receive the first signal, and selectively control, according to the first signal, the conduction control unit to be in a first conductive state or a second conductive state. The switch unit is configured to receive the second signal and control, according to a conductive state of the conduction selection unit and a potential of the second signal, the second end of the first light-emitting element and/or the second end of the second light-emitting element to be electrically connected to the first power supply.

In some embodiments, the conduction selection unit includes a first selection transistor, a second selection transistor, a third selection transistor, and a fourth selection transistor, a control end of the first selection transistor is configured to receive the first signal, and a control end of the second selection transistor is configured to receive an inverted signal, the first end of the first selection transistor and a first end of the second selection transistor are configured to receive a power-supply control signal, a second end of the first selection transistor is electrically connected to a first end of the third selection transistor and the conduction control unit, a second end of the second selection transistor is electrically connected to a first end of the fourth selection transistor and the conduction control unit.

A control end of the third selection transistor is electrically connected to the second end of the second selection transistor; a control end of the fourth selection transistor is electrically connected to the second end of the first selection transistor; and a second end of the third selection transistor and a second end of the fourth selection transistor are both electrically connected to the first power supply.

In some embodiments, when the first signal is at a first potential, the inverted signal is at a second potential, the first selection transistor and the fourth selection transistor are turned off, the second selection transistor and the third selection transistor are turned on, and the power-supply control signal is transmitted from the second end of the second selection transistor to the conduction control unit. When the first signal is at the second potential, the inverted signal is at the first potential, the second selection transistor and the third selection transistor are turned off, the first selection transistor and the fourth selection transistor are turned on, and the power-supply control signal is transmitted from the second end of the first selection transistor to the conduction control unit.

In some embodiments, the conduction control unit includes a first conductive transistor and a second conductive transistor, a control end of the first conductive transistor is electrically connected to the second end of the second selection transistor, a control end of the second conductive transistor is electrically connected to the second end of the first selection transistor, a first end of the first conductive transistor and a first end of the second conductive transistor are electrically connected to the first power supply, a second end of the first conductive transistor and a second end of the second conductive transistor are electrically connected to the switch unit.

When the first conductive transistor receives the power-supply control signal from the second selection transistor, the first conductive transistor is turned on, the second conductive transistor is turned off, and the conduction control unit is in the first conductive state; when the second conductive transistor receives the power-supply control signal from the first selection transistor, the first conductive transistor is turned off, the second conductive transistor is turned on, and the conduction control unit is in the second conductive state.

In some embodiments, the switch unit includes a first discharge transistor, a second discharge transistor, a third discharge transistor, and a fourth discharge transistor, a control end of the first discharge transistor is electrically connected to the second end of the first conductive transistor, a control end of the second discharge transistor is electrically connected to the second end of the second conductive transistor, a first end of the first discharge transistor and a first end of the second discharge transistor are electrically connected to the second power supply, a second end of the first discharge transistor is electrically connected to a second end of the second conductive transistor, a second end of the second discharge transistor is electrically connected to the second end of the first conductive transistor.

A control end of the third discharge transistor is configured to receive the second signal; a first end of the third discharge transistor is electrically connected to a second end of the second conductive transistor and a second end of the first discharge transistor; a second end of the third discharge transistor is electrically connected to the second end of the second light-emitting element.

A control end of the fourth discharge transistor is configured to receive the second signal; a first end of the fourth discharge transistor is electrically connected to a second end of the first conductive transistor and a second end of the second discharge transistor; and a second end of the fourth discharge transistor is electrically connected to a second end of the first light-emitting element.

In some embodiments, when the conduction control unit is in the first conductive state and the second signal is at a first potential, the first discharge transistor, the third discharge transistor, and the fourth discharge transistor are turned on, the second discharge transistor is turned off, and a first cathode voltage of the first power supply is transferred to the second end of the first light-emitting element, the first light-emitting element is configured to emit light, and a second cathode voltage of the second power supply is transferred to the second end of the second light-emitting element.

When the conduction control unit is in the second conductive state and the second signal is at the first potential, the second discharge transistor, the third discharge transistor, and the fourth discharge transistor are turned on, the first discharge transistor is turned off, and a first cathode voltage of the first power supply is transferred to the second end of the second light-emitting element, the second light-emitting element is configured to emit light, and a second cathode voltage of the second power supply is transferred to the second end of the first light-emitting element.

In some embodiments, when the conduction control unit is in the second conductive state and the second signal is at the first potential, the second discharge transistor, the third discharge transistor, and the fourth discharge transistor are turned on, the first discharge transistor is turned off, and a first cathode voltage of the first power supply is transferred to the second end of the second light-emitting element, the second light-emitting element is configured to emit light, and a second cathode voltage of the second power supply is transferred to the second end of the first light-emitting element. When the second signal is at the second potential, both the first switch transistor and the second switch transistor are in turned on, and the first cathode voltage of the first power supply is transferred to the second end of the first light-emitting element and the second end of the second light-emitting element.

Please refer to FIG. 1, FIG. 1 is a schematic structural diagram of a display device 100 according to an embodiment of the disclosure. As shown in FIG. 1, the display device 100 provided in embodiments of the disclosure may at least include a display panel 10, a power supply module 20, and a support frame 30. The display panel 10 is fixed to the support frame 30, and the power supply module 20 is arranged on the back side of the display panel 10, that is, the non-display surface of the display panel 10, that is, the side of the display panel 10 facing away from the user. The display panel 10 is used for displaying an image(s). The power supply module 20 is electrically connected to the display panel 10 and is used for providing a power supply voltage for the display panel 10 to display an image. The support frame 30 supports and protects the display panel 10 and the power supply module 20.

It can be understood that, the display panel 10 further has a display surface which is opposite to the non-display surface, that is, a front side of the display panel 10, that is, a side of the display panel 10 facing a user. The display surface faces a user who uses the display device 100 to display an image.

Figure 2:
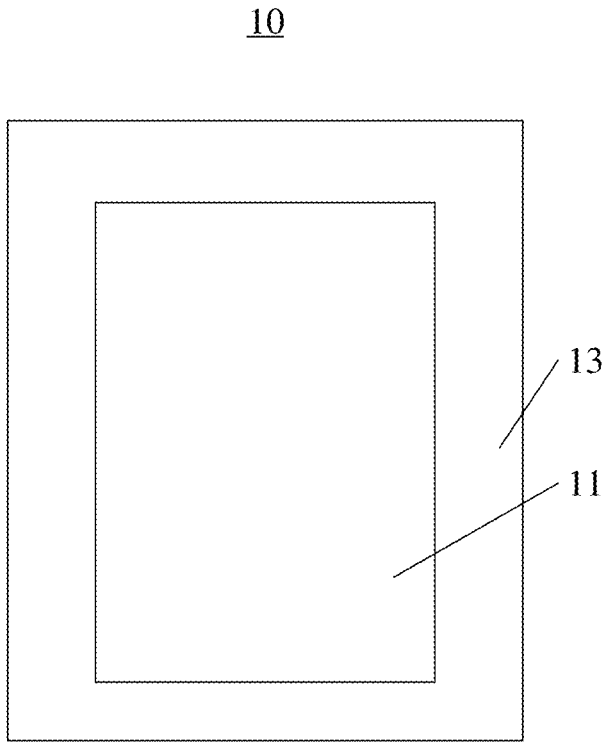
FIG. 2 is a schematic structural diagram of a display panel in the display device shown in FIG. 1.

Please also refer to FIG. 2, FIG. 2 is a schematic structural diagram showing a display panel 10 of the display device 100 shown in FIG. 1. As shown in FIG. 2, the display panel 10 includes a display area 11 and a non-display area 13. The display area 11 is used for image display, and the non-display area 13 is disposed around the display area 11 and is not used for image display. It should be understood that, in some embodiments, the display panel 10 may use a liquid crystal material as a display medium, which is not limited thereto.

In embodiments of the disclosure, multiple scan lines extending along a first direction F1 and multiple data lines extending along a second direction F2 are provided within the display panel 10 in a grid-like manner. The first direction F1 is perpendicular to the second direction F2 (see FIG. 5), and the multiple scan lines, the multiple data lines, and the scan lines and the data lines are insulated from one another. That is, the multiple scan lines are arranged at intervals along the second direction F2 and insulated from one another, the multiple data lines are arranged at intervals along the first direction F1 and insulated from one another, and the multiple scan lines and the multiple data lines are insulated from one another.

A pixel circuit 40 (see FIG. 4) is disposed at each of intersections of the multiple scan lines and the multiple data lines, and specifically, the pixel circuit 40 is disposed between any two adjacent scan lines and any two adjacent data lines. The pixel circuits 40 in the same column are all electrically connected to the same data line, and the pixel circuits 40 in the same row are all electrically connected to the same scan line. In embodiments of the disclosure, the multiple pixel circuits 40 are arranged in an array.

Figure 3:
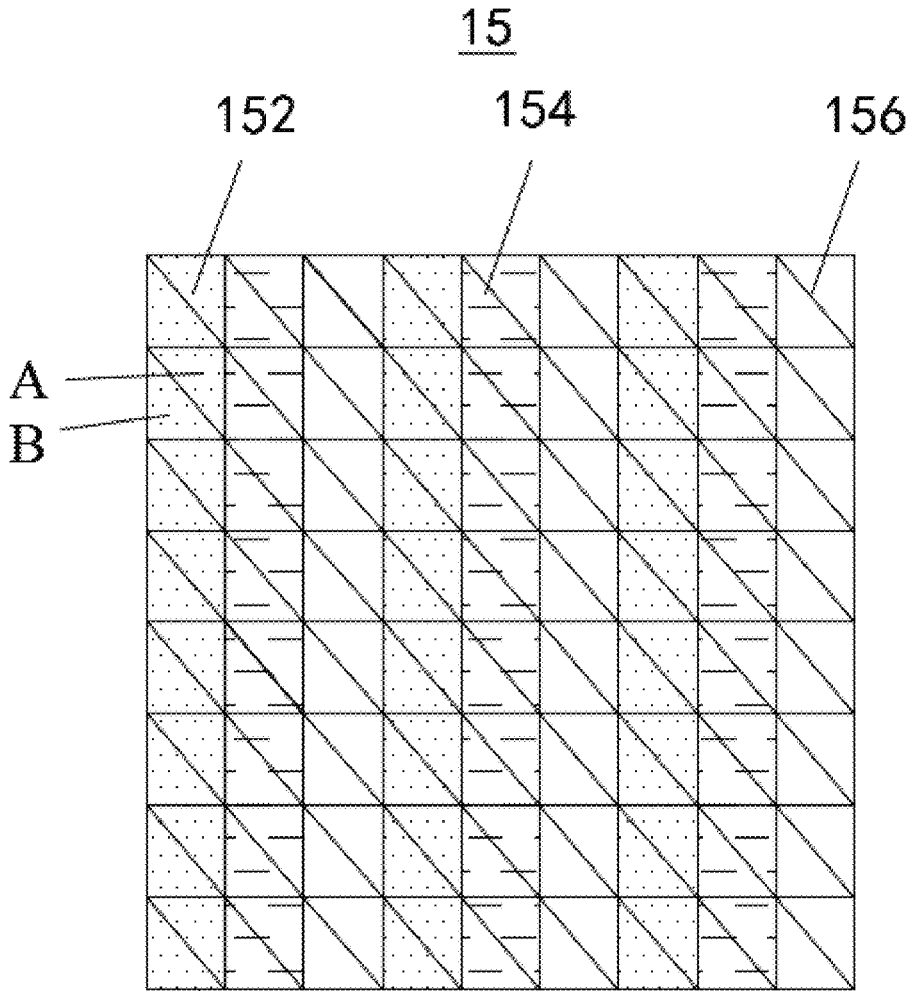
FIG. 3 is a schematic structural diagram of a pixel unit in the display panel shown in FIG. 2.

Please also refer to FIG. 3, FIG. 3 is a schematic structural diagram of a pixel unit in the display panel 10 shown in FIG. 2. As shown in FIG. 3, the display panel 10 includes pixel units 15 for display, and each pixel unit 15 corresponds to one pixel circuit 40. The pixel unit 15 includes multiple rows and multiple columns of sub-pixels. Each row includes a first sub-pixel 152, a second sub-pixel 154, and a third sub-pixel 156 which are sequentially arranged. Each column includes multiple sub-pixels of the same color, and each row of sub-pixels and each column of sub-pixels form a pixel array.

In embodiments of the disclosure, the first sub-pixel 152 may be a red sub-pixel, the second sub-pixel 154 may be a green sub-pixel, and the third sub-pixel 156 may be a blue sub-pixel. The first sub-pixel 152, the second sub-pixel 154, and the third sub-pixel 156 may not comply with the described correspondence in color, and they can be sub-pixels of other colors, which is not specifically limited in the disclosure.

As shown in FIG. 3, in embodiments of the disclosure, each sub-pixel includes a first light-emitting element A and a second light-emitting element B. Specifically, each of the first sub-pixel 152, the second sub-pixel 154, and the third sub-pixel 156 includes the first light-emitting element A and the second light-emitting element B. In an exemplary embodiment, both the first light-emitting element A and the second light-emitting element B may be Organic Light-Emitting Diodes (OLEDs), and thus the display panel 10 forms a dual-light OLED display.

Figure 4:
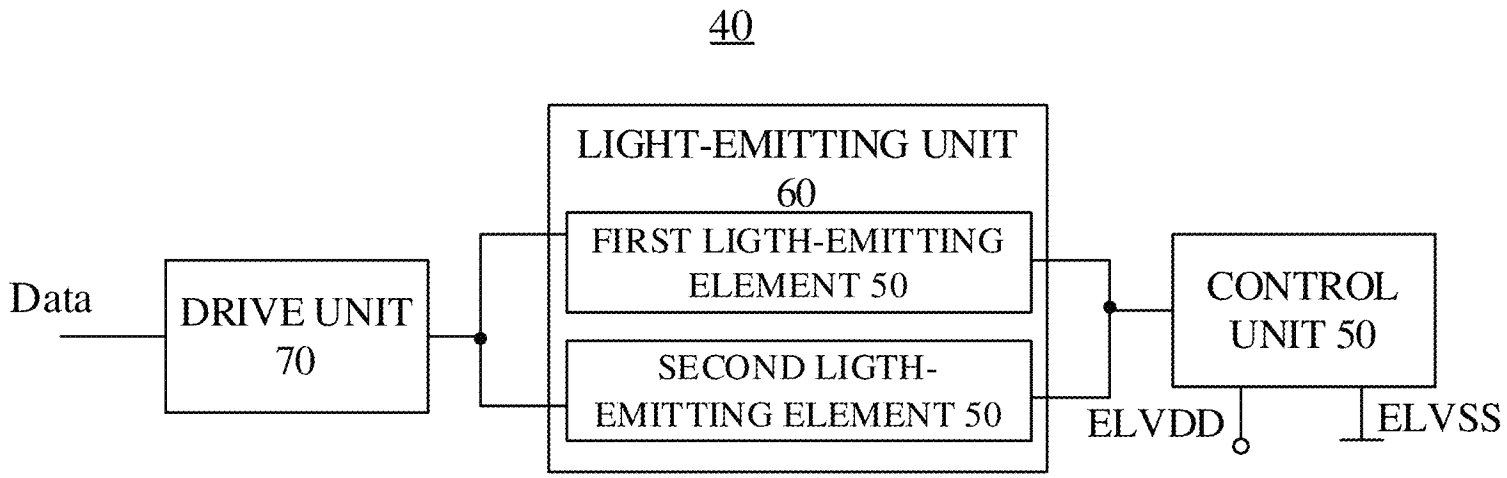
FIG. 4 is a schematic diagram of a circuit structure of a pixel circuit disclosed in an embodiment of the disclosure.

Please also refer to FIG. 4, FIG. 4 is a schematic diagram of a circuit structure of a pixel circuit 40 according to embodiments of the disclosure. As shown in FIG. 4, in embodiments of the disclosure, the pixel circuit 40 includes a control unit 50, a light-emitting unit 60, and a drive unit 70. The light-emitting unit 60 includes the first light-emitting element A and the second light-emitting element B, and the first light-emitting element A and the second light-emitting element B are both electrically connected to the drive unit 70 and the control unit 50.

The drive unit 70 is configured to transmit a data signal Data to the light-emitting unit 60, the data signal Data is used for driving the first light-emitting element A and/or the second light-emitting element B to emit light. The control unit 50 is configured to control the first light-emitting element A and/or the second light-emitting element B to be electrically connected to a first power supply ELVSS. When the light-emitting unit 60 receives the data signal Data, the control unit 50 selectively controls the first light-emitting element A and/or the second light-emitting element B to emit light.

In embodiments of the disclosure, the color of light of the light-emitting unit 60 may be the color of the first sub-pixel 152, the second sub-pixel 154, or the third sub-pixel 156 correspondingly, which is not specifically limited in the disclosure.

In embodiments of the disclosure, the control unit 50 is also configured to control the first light-emitting element A or the second light-emitting element B to be electrically connected to a second power supply ELVDD, for the first light-emitting element A or the second light-emitting element B to release (that is, discharge) the charges accumulated therein.

In a specific embodiment of the disclosure, the first power supply ELVSS may be a low potential pixel power supply, and the second power supply ELVDD may be a high potential pixel power supply, which is not specifically limited in the disclosure.

Figure 5:
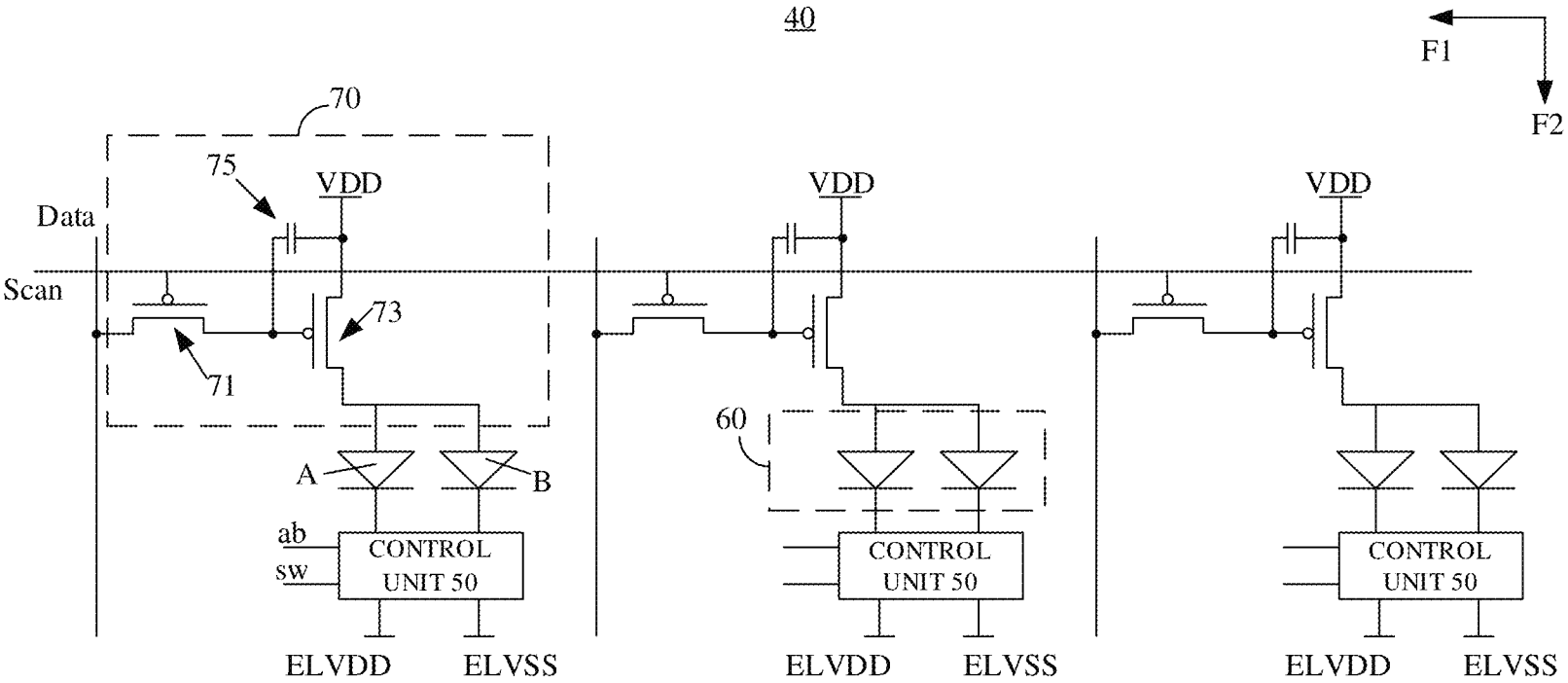
FIG. 5 is a schematic diagram of a specific circuit structure of the pixel circuit shown in FIG. 4.

Please also refer to FIG. 5, FIG. 5 is a schematic diagram of a specific circuit structure of the pixel circuit 40 shown in FIG. 4. As shown in FIG. 5, in embodiments of the disclosure, the drive unit 70 includes a data input end, a scan input end, and an output end. The data input end is electrically connected to the data line, and the drive unit 70 is configured to receive the data signal Data via the data line. The scan input end is electrically connected to the scan line, and the drive unit 70 is configured to receive a scan signal Scan via the scan line. The drive unit 70 selectively controls the power supply signal VDD to be transmitted from the output end to the light-emitting unit 60 according to the received data signal Data and the scan signal Scan.

In a specific embodiment of the disclosure, the drive unit 70 may include a first transistor 71, a second transistor 73, and a storage capacitor 75. Specifically, each of the first transistor 71 and the second transistor 73 includes a control end, a first end, and a second end. One end of the storage capacitor 75 is electrically connected to the second end of the first transistor 71, and the other end of the storage capacitor 75 is electrically connected to the first end of the second transistor 73. The storage capacitor 75 is configured to store image data which is used for controlling the light-emitting unit 60 to emit light.

The control end of the first transistor 71 is electrically connected to the scan input end, and is configured to receive the scan signal Scan from the scan input end. The first end of the first transistor 71 is electrically connected to the data input end, and is configured to receive the data signal Data from the data input end. The second end of the first transistor 71 is electrically connected to the control end of the second transistor 73.

The first transistor 71 is selectively electrically connected or disconnected according to a potential of the received scan signal Scan.

Specifically, when the scan signal Scan received by the first transistor 71 is at a first potential, the first end of the first transistor 71 and the second end of the first transistor 71 are electrically disconnected. When the scan signal Scan received by the first transistor 71 is at a second potential, the first end of the first transistor 71 and the second end of the first transistor 71 are electrically connected. In this case, the data signal Data is transmitted to the control end of the second transistor 73 from the second end of the first transistor 71.

In a specific embodiment of the disclosure, the first end of the second transistor 73 is configured to receive the power supply signal VDD, and the second end of the second transistor 73 is electrically connected to the output end. The second transistor 73 is selectively turned on or off according to the data signal Data received by the control end. That is, the second transistor 73 is selectively electrically connected or disconnected according to the potential of the received data signal Data, so as to selectively transmit the power supply signal VDD to the output end.

Specifically, when the data signal Data received by the second transistor 73 is at the first potential, the first end of the second transistor 73 is electrically disconnected from the second end of the second transistor 73. When the data signal Data received by the second transistor 73 is at the second potential, the first end of the second transistor 73 is electrically connected to the second end of the second transistor 73. In this case, the power supply signal VDD is transmitted to the output end, and further, the power supply signal VDD is transmitted to the light-emitting unit 60 through the output end.

In embodiments of the disclosure, the first potential may be a high potential, and the second potential may be a low potential, which is not specifically limited in the disclosure.

In embodiments of the disclosure, the first transistor 71 and the second transistor 73 may be P-Metal-Oxide-Semiconductor (PMOS) transistors, which is not specifically limited in the disclosure. The first end may be a drain electrode ("drain" for short), the second end may be a source electrode ("source" for short), and the control end may be a gate electrode ("gate" for short).

With continued reference to FIG. 5, the light-emitting unit 60 may include the first light-emitting element A and the second light-emitting element B. The first end of the first light-emitting element A and the first end of the second light-emitting element B are both electrically connected to the output end, and the second end of the first light-emitting element A and the second end of the second light-emitting element B are both electrically connected to the control unit 50. The first ends of the first light-emitting element A and the second light-emitting element B may be anodes, and the second ends thereof may be cathodes.

In embodiments of the disclosure, the control unit 50 is configured to receive the first signal ab and the second signal sw, and control, according to the potentials of the received first signal ab and the second signal sw, the second end of the first light-emitting element A and/or the second end of the second light-emitting element B to be electrically connected to the first power supply ELVSS, so as to selectively control the first light-emitting element A and/or the second light-emitting element B to emit light.

In embodiments of the disclosure, when the first signal ab received by the control unit 50 is at the first potential and the second signal sw is at the first potential, the second end of the first light-emitting element A is electrically connected to the first power supply ELVSS and receives the first cathode voltage from the first power supply ELVSS. In this case, the first light-emitting element A emits light.

When the first signal ab received by the control unit 50 is at the second potential and the second signal sw is at the first potential, the second end of the second light-emitting element B is electrically connected to the first power supply ELVSS and receives the first cathode voltage from the first power supply ELVSS. In this case, the second light-emitting element B emits light.

When the second signal sw received by the control unit 50 is at the second potential, no matter whether the first signal ab is at the first potential or the second potential, the second end of the first light-emitting element A and the second end of the second light-emitting element B are both electrically connected to the first power supply ELVSS, and simultaneously receives a first cathode voltage from the first power supply ELVSS, and in this case, both the first light-emitting element A and the second light-emitting element B emit light.

In embodiments of the disclosure, the control unit 50 may also control the second end of the first light-emitting element A or the second end of the second light-emitting element B to be electrically connected to the second power supply ELVDD, and receive a second cathode voltage from the second power supply ELVDD.

When the first end of the first light-emitting element A and/or the first end of the second light-emitting element B receives the power supply signal VDD and the second ends thereof receive the second cathode voltage, an external electric field of the first light-emitting element A and/or the second light-emitting element B is in the same direction as an internal field formed by accumulated charges, thus the charges accumulated inside the first light-emitting element A and/or the second light-emitting element B are thus depleted. In this way, the service life of the light-emitting unit 60 is prolonged, and the risk of screen burning is reduced.

Specifically, in embodiments of the disclosure, when the first signal ab received by the control unit 50 is at the first potential and the second signal sw is at the first potential, the second end of the second light-emitting element B is electrically connected to the second power supply ELVDD, and receives the second cathode voltage from the second power supply ELVDD. In this case, an external electric field of the second light-emitting element B is in the same direction as an electric field formed by the charges accumulated inside the second light-emitting element B, and the charges accumulated inside the second light-emitting element B are depleted, thereby prolonging the service life of the second light-emitting element B and reducing the risk of screen burning.

When the first signal ab received by the control unit 50 is at the second potential and the second signal sw is at the first potential, the second end of the first light-emitting element A is electrically connected to the second power supply ELVDD, and receives the second cathode voltage from the second power supply ELVDD. In this case, an external electric field of the first light-emitting element A is in the same direction as an electric field formed by the charges accumulated inside the first light-emitting element A, and the charges accumulated inside the first light-emitting element A are depleted, thereby prolonging the service life of the first light-emitting element A and reducing the risk of screen burning.

When the second signal sw received by the control unit 50 is at the second potential, no matter whether the first signal ab is at the first potential or the second potential, the second end of the first light-emitting element A and the second end of the second light-emitting element B are both electrically connected to the first power supply ELVSS, and receive the first cathode voltage from the first power supply ELVSS. In this case, both the first light-emitting element A and the second light-emitting element B emit light to supplement the luminance of the light emitting element, so as to avoid the problem of image sticking or screen burning caused by insufficient luminance, thereby improving the service life of the pixel circuit 40 and improving the display effect of the display panel 10.

In specific embodiments of the disclosure, it can be understood that, in order to enable an external electric field of the light-emitting element to be in the same direction as a built-in electric field, the potential of the second cathode voltage of the second power supply ELVDD is higher than the potential of the power supply signal VDD. Meanwhile, the potential of the first cathode voltage of the first power supply ELVSS should be lower than the potential of the power supply signal VDD, so as to ensure that the light-emitting element emits light normally. At the same time, it can be understood that, the power supply signal VDD is used for driving the light-emitting element to emit light, and the voltage value of the power supply signal VDD should match the luminance of the light-emitting element, which is not specifically limited in the disclosure.

In embodiments of the disclosure, there is a pre-set switching time for the first signal ab to switch from the first potential to the second potential or to switch from the second potential to the first potential. The pre-set switching time can be determined according to specific situations, and the pre-set switching time can be one frame, ten frames, 100 frames or other numerical values, which is not specifically limited in the disclosure.

In embodiments of the disclosure, the switching time for the second signal sw to switch from the first potential to the second potential or from the second potential to the first potential can also be determined according to practical situations, which is not specifically limited in the disclosure.

Next, different light emission paths of the pixel circuit 40 will be described.

The first light-emitting element A emits light: the drive unit 70 receives the scan signal Scan at the second potential and the data signal Data at the second potential, thus, the first transistor 71 and the second transistor 73 are in an ON-state, that is, turned on. The power supply signal VDD is output from the output end to the light-emitting unit 60, and the first end of the first light-emitting element A and the first end of the second light-emitting element B each receive the power supply signal. The control unit 50 receives the first signal ab at the first potential and the second signal sw at the first potential, such that the second end of the first light-emitting element A is electrically connected to the first power supply ELVSS to receive the first cathode voltage, and the second end of the second light-emitting element B is electrically connected to the second power supply ELVDD to receive the second cathode voltage. In this case, the first light-emitting element A emits light, and the second light-emitting element B release charges accumulated therein.

The second light-emitting element B emits light: the drive unit 70 receives the scan signal Scan at the second potential and the data signal Data at the second potential, thus, the first transistor 71 and the second transistor 73 are in the ON-state. The power supply signal is output from the output end to the light-emitting unit 60, and the first end of the first light-emitting element A and the first end of the second light-emitting element B each receive the power supply signal. The control unit 50 receives the first signal ab at the second potential and the second signal sw at the first potential, such that the second end of the second light-emitting element B is electrically connected to the first power supply ELVSS to receive the first cathode voltage, and the second end of the first light-emitting element A is electrically connected to the second power supply ELVDD to receive the second cathode voltage. In this case, the second light-emitting element B emits light, and the first light-emitting element A releases charges accumulated therein.

The first light-emitting element A and the second light-emitting element B both emit light: the drive unit 70 receives the scan signal Scan at the second potential and the data signal Data at the second potential, thus, the first transistor 71 and the second transistor 73 are in an ON-state. The power supply signal is output from the output end to the light-emitting unit 60, and the first end of the first light-emitting element A and the first end of the second light-emitting element B each receive the power supply signal. The control unit 50 receives the second signal sw at the second potential, so that the second end of the first light-emitting element A and the second end of the second light-emitting element B are both electrically connected to the first power supply ELVSS to receive the first cathode voltage. In this case, both the first light-emitting element A and the second light-emitting element B emit light.

Figure 6:
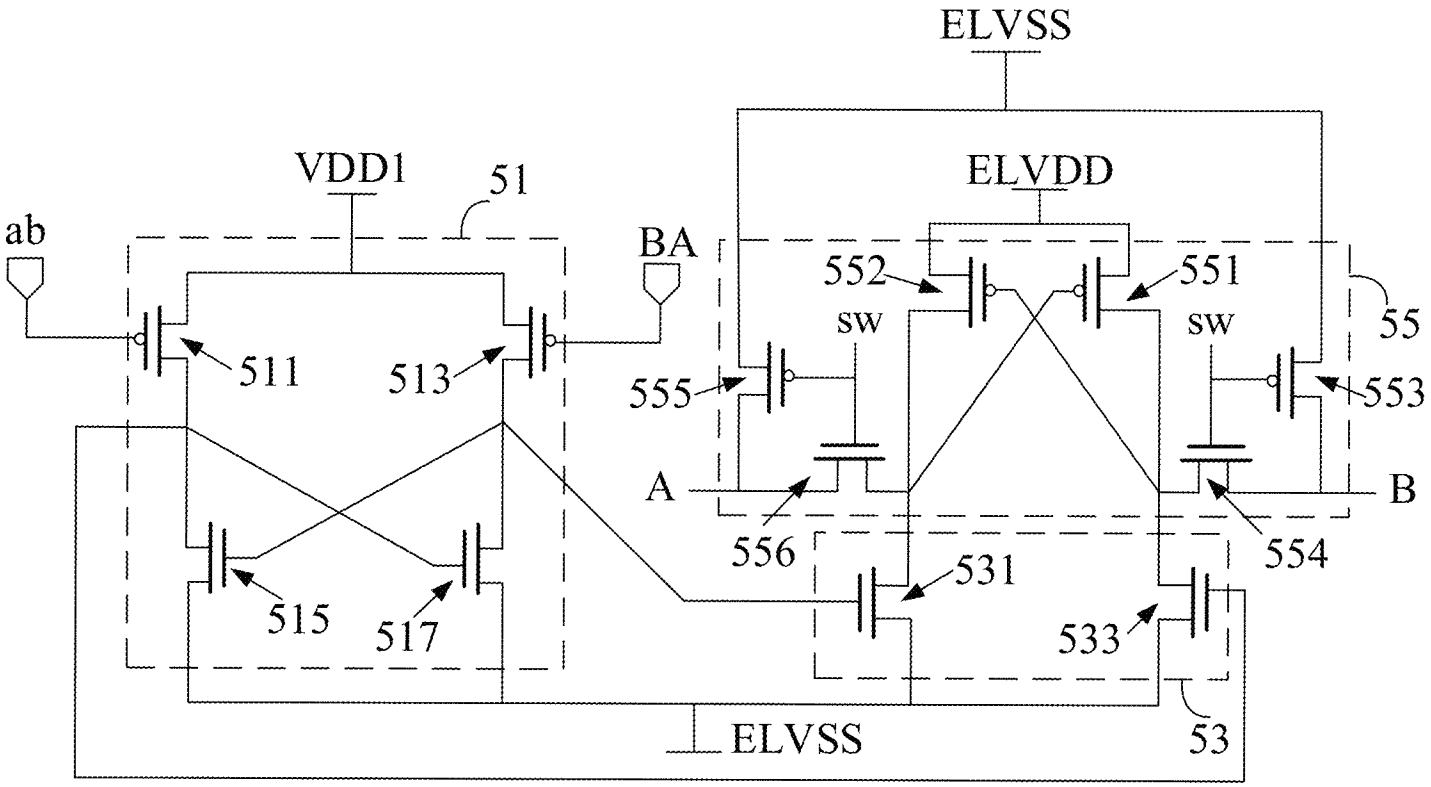
FIG. 6 is a schematic diagram of a circuit structure of a control unit in the pixel circuit shown in FIG. 5.

Please also refer to FIG. 6, FIG. 6 is a schematic circuit diagram of the control unit 50 in the pixel circuit 40 shown in FIG. 5. As shown in FIG. 6, in embodiments of the disclosure, the control unit 50 includes a conduction selection unit 51, a conduction control unit 53, and a switch unit 55. The conduction control unit 53 is electrically connected to both the conduction selection unit 51 and the switch unit 55, and the switch unit is also electrically connected to the first light-emitting element and the second light-emitting element. The conduction selection unit 51 is configured to receive the power supply control signal VDD1 and the first signal ab, and selectively control, according to the first signal ab, the conduction control unit 53 to be in a first conductive state or a second conductive state. The switch unit 55 receives the second signal sw, and the switch unit 55 controls the second end of the first light-emitting element and/or the second end of the second light-emitting element to be connected to the first power source according to the conductive state of the conduction selection unit 51 and the potential of the second signal sw. Specifically, the switch unit 55 controls the second end of the first light-emitting element A to be connected to the first power supply ELVSS, and the second end of the second light-emitting element B to be connected to the second power supply ELVDD. Alternatively, drive the second end of the second light-emitting element B to be electrically connected to the first power supply ELVSS, and drive the second end of the first light-emitting element A to be electrically connected to the second power supply ELVDD. Alternatively, the second end of the first light-emitting element A and the second end of the second light-emitting element B are both connected to the first power supply ELVSS.

As shown in FIG. 6, in embodiments of the disclosure, the conduction selection unit 51 includes a first selection transistor 511, a second selection transistor 513, a third selection transistor 515, and a fourth selection transistor 517. A control end of the first selection transistor 511 is configured to receive the first signal ab, and a control end of the second selection transistor 513 is configured to receive an inverted signal BA of the first signal ab. A first end of the first selection transistor 511 and a first end of the second selection transistor 513 are configured to receive the power supply control signal VDD1, and a second end of the first selection transistor 511 is electrically connected to both the first end of the third selection transistor 515 and the conduction control unit 53. A second end of the second selection transistor 513 is electrically connected to a first end of the fourth selection transistor 517 and the conduction control unit 53. The inverted signal BA of the first signal ab is NOT-a and NOT-b.

A control end of the third selection transistor 515 is electrically connected to the second end of the second selection transistor 513. A control end of the fourth selection transistor 517 is electrically connected to the second end of the first selection transistor 511. A second end of the third selection transistor 515 and a second end of the fourth selection transistor 517 are both electrically connected to the first power supply ELVSS.

In embodiments of the disclosure, the control end of the first selection transistor 511 is configured to receive the first signal ab, and the first signal ab controls the first end of the first selection transistor 511 to be electrically connected to or disconnected from the second end of the first selection transistor 511.

In embodiments of the disclosure, the control end of the fourth selection transistor 517 is configured to receive the power supply control signal VDD1 from the second end of the first selection transistor 511, and the power supply control signal VDD1 controls the first selection transistor 511 to be in an ON-state or an OFF-state, that is, turned on or turned off. Meanwhile, the power supply control signal VDD1 is selectively transmitted to the conduction control unit 53 from the second end of the first selection transistor 511.

When the first signal ab is at the first potential, the first end of the first selection transistor 511 is electrically disconnected from the second end of the first selection transistor 511, and the power supply control signal VDD1 cannot be transmitted from the first end to the second end. In this case, the control end of the fourth selection transistor 517 fails to receive the power supply control signal VDD1, and is in an OFF-state. The power supply control signal VDD1 cannot be transmitted to the conduction control unit 53 from the second end of the first selection transistor 511.

When the first signal ab is at the second potential, the first end of the first selection transistor 511 is electrically connected to and the second end of the first selection transistor 511, and the power supply control signal VDD1 is transmitted from the first end to the second end. In this case, the control end of the fourth selection transistor 517 receives the power supply control signal VDD1, and is in an ON-state. The power supply control signal VDD1 is transmitted to the conduction control unit 53 from the second end of the first selection transistor 511.

In embodiments of the disclosure, the control end of the second selection transistor 513 is configured to receive the inverted signal BA of the first signal ab, and the inverted signal BA controls the first end and the second end of the second selection transistor 513 to be electrically connected to or disconnected from each other.

In embodiments of the disclosure, the control end of the third selection transistor 515 is configured to receive the power supply control signal VDD1 from the second end of the second selection transistor 513, and the power supply control signal VDD1 controls the third selection transistor 515 to be in an ON-state or an OFF-state. Meanwhile, the power supply control signal VDD1 is selectively transmitted to the conduction control unit 53 from the second end of the second selection transistor 513.

When the inverted signal BA is at the first potential, the first end and the second end of the second selection transistor 513 are electrically disconnected, and the power supply control signal VDD1 cannot be transmitted from the first end to the second end of the second selection transistor 513. In this case, the control end of the third selection transistor 515 does not receive the power supply control signal VDD1, and is in an OFF-state. The power supply control signal VDD1 cannot be transmitted to the conduction control unit 53 from the second end of the second selection transistor 513.

When the inverted signal BA is at the second potential, the first end and the second end of the second selection transistor 513 are electrically connected, and the power supply control signal VDD1 is transmitted from the first end to the second end of the second selection transistor 513. In this case, the control end of the third selection transistor 515 receives the power supply control signal VDD1, and is in an ON-state. The power supply control signal VDD1 is transmitted to the conduction control unit 53 from the second end of the second selection transistor 513.

In embodiments of the disclosure, the conduction control unit 53 includes a first conductive transistor 531 and a second conductive transistor 533. A control end of the first conductive transistor 531 is electrically connected to the second end of the second selection transistor 513, and a control end of the second conductive transistor 533 is electrically connected to the second end of the first selection transistor 511. A first end of the first conductive transistor 531 and a first end of the second conductive transistor 533 are both electrically connected to the first power supply ELVSS. A second end of the first conductive transistor 531 and a second end of the second conductive transistor 533 are both electrically connected to the switch unit 55.

In embodiments of the disclosure, the control end of the first conductive transistor 531 is configured to receive the power supply control signal VDD1 from the second end of the second selection transistor 513, and the power supply control signal VDD1 controls the first conductive transistor 531 to be in an ON-state or an OFF-state.

The control end of the second conductive transistor 533 is configured to receive the power supply control signal VDD1 from the second end of the first selection transistor 511, and the power supply control signal VDD1 controls the second conductive transistor 533 to be in an ON-state or an OFF-state.

Since the power supply control signal VDD1 is always at the first potential, when the first conductive transistor 531 or the second conductive transistor 533 receives the power supply control signal VDD1, the first conductive transistor 531 or the second conductive transistor 533 is turned on. At this time, the second end of the first conductive transistor 531 or the second end of the second conductive transistor 533 is connected to the first power supply ELVSS.

Specifically, when the control end of the first conductive transistor 531 receives the power supply control signal VDD1 from the second end of the second selection transistor 513, the first conductive transistor 531 is in an ON-state, and the second conductive transistor 533 is in an OFF-state. In this case, the conduction control unit 53 is in the first conductive state.

When the control end of the second conductive transistor 533 receives the power supply control signal VDD1 from the second end of the first selection transistor 511, the first conductive transistor 531 is in an OFF-state, and the second conductive transistor 533 is in an ON-state. In this case, the conduction control unit 53 is in the second conductive state.

In embodiments of the disclosure, the switch unit 55 includes a first discharge transistor 551, a second discharge transistor 552, a third discharge transistor 554, and a fourth discharge transistor 556. A control end of the first discharge transistor 551 is electrically connected to the second end of the first conductive transistor 531, and a control end of the second discharge transistor 552 is electrically connected to the second end of the second conductive transistor 533. A first end of the first discharge transistor 551 and a first end of the second discharge transistor 552 are both electrically connected to the second power supply ELVDD. A second end of the first discharge transistor 551 is electrically connected to a second end of the second conductive transistor 533, and a second end of the second discharge transistor 552 is electrically connected to a second end of the first conductive transistor 531.

A control end of the third discharge transistor 554 is configured to receive the second signal sw. A first end of the third discharge transistor 554 is electrically connected to both the second end of the second conductive transistor 533 and the second end of the first discharge transistor 551. A second end of the third discharge transistor 554 is electrically connected to the second end of the second light-emitting element B.

A control end of the fourth discharge transistor 556 is configured to receive the second signal sw, and a first end of the fourth discharge transistor 556 is electrically connected to the second end of the first conductive transistor 531 and the second end of the second discharge transistor 552. A second end of the fourth discharge transistor 556 is electrically connected to the second end of the first light-emitting element A.

In embodiments of the disclosure, the control end of the first discharge transistor 551 is configured to receive a first cathode voltage of the first power supply ELVSS from the second end of the first conductive transistor 531, and the first cathode voltage of the first power supply ELVSS controls the first end and the second end of the first discharge transistor 551 to be electrically connected to each other.

The control end of the second discharge transistor 552 is configured to receive the first cathode voltage of the first power supply ELVSS from the second end of the second conductive transistor 533, and the first cathode voltage of the first power supply ELVSS controls the first end and the second end of the second discharge transistor 552 to be electrically connected to each other.

In this embodiment, because the first cathode voltage is always at the second potential, when the control end of the first discharge transistor 551 or the second discharge transistor 552 receives the first cathode voltage, the first discharge transistor 551 or the second discharge transistor 552 is in an ON-state. In this case, the second cathode voltage of the second power supply ELVDD is transferred to the second end from the first end of the first discharge transistor 551 or the first end of the second discharge transistor 552.

In embodiments of the disclosure, the control end of the third discharge transistor 554 receives a second signal sw, and the second signal sw controls the third discharge transistor 554 to be in an ON-State or OFF-state.

Specifically, when the second signal sw is at the first potential, the third discharge transistor 554 is turned on, and when the second signal sw is at the second potential, the third discharge transistor 554 is turned off.

In embodiments of the disclosure, the control end of the fourth discharge transistor 556 receives a second signal sw, and the second signal sw controls the fourth discharge transistor 556 to be in an ON-State or OFF-state.

Specifically, when the second signal sw is at the first potential, the fourth discharge transistor 556 is in the ON-state. When the second signal sw is at the second potential, the fourth discharge transistor 556 is in an OFF-state. Accordingly, when the third discharge transistor 554 is in the ON-state and the conduction control unit 53 is in the first conductive state, the first light-emitting element A emits light. When the fourth discharge transistor 556 is in the ON-state and the conduction control unit 53 is in the second conductive state, the second light-emitting element B emits light.

In embodiments of the disclosure, the switch unit 55 further includes a first switch transistor 555 and a second switch transistor 553. A control end of the first switch transistor 555 and a control end of the second switch transistor 553 are configured to receive the second signal sw, and a first end of the first switch transistor 555 and a second end of the second switch transistor 553 are both electrically connected to the first power supply ELVSS. A second end of the first switch transistor 555 is electrically connected to a second end of the first light-emitting element A, and a second end of the second switch transistor 553 is electrically connected to a second end of the second light-emitting element B.

In embodiments of the disclosure, the second signal sw controls the first switch transistor 555 and the second switch transistor 553 to be in an ON-state or OFF-state.

When the second signal sw is at the second potential, the first switch transistor 555 and the second switch transistor 553 are both turned on, the second end of the first switch transistor 555 and the second end of the second switch transistor 553 are both electrically connected to the first power supply ELVSS, and thus the second end of the first light-emitting element A and the second end of the second light-emitting element B are both electrically connected to the first power supply ELVSS. In this case, both the first light-emitting element A and the second light-emitting element B emit light to supplement the luminance of the light-emitting elements, so as to avoid the problem of image sticking or screen burning due to insufficient luminance, thereby improving the service life of the pixel circuit 40 and improving the display effect of the display panel 10.

When the second signal sw is at the first potential, the first switch transistor 555 and the second switch transistor 553 are both turned off. Signal inputs at the second end of the first light-emitting element A and the second end of the second light-emitting element B are controlled by the first discharge transistor 551, the second discharge transistor 552, the third discharge transistor 554, and the fourth discharge transistor 556.

In a specific embodiment of the disclosure, when the conduction control unit 53 is in the first conductive state and the second signal sw is at the first potential, the first discharge transistor 551, the third discharge transistor 554, and the fourth discharge transistor 556 are turned on, the second discharge transistor 552 is turned off. A first cathode voltage of the first power supply ELVSS is transferred to the second end of the first light-emitting element A, the first light-emitting element A emits light, and a second cathode voltage of the second power supply ELVDD is transferred to the second end of the second light-emitting element B.

When the conduction control unit 53 is in the second conductive state and the second signal sw is at the first potential, the second discharge transistor 552, the third discharge transistor 554, and the fourth discharge transistor 556 are turned on, the first discharge transistor 551 is turned off. The first cathode voltage of the first power supply ELVSS is transferred to the second end of the second light-emitting element B, the second light-emitting element B emits light, and the second cathode voltage of the second power supply ELVDD is transferred to the second end of the first light-emitting element A.

When the second signal sw is at the first potential, regardless the conductive state of the conduction control unit 53, both the first switch transistor 555 and the second switch transistor 553 are turned on, and the first cathode voltage of the first power supply ELVSS is transferred to the second end of the first light-emitting element A and the second end of the second light-emitting element B respectively.

In embodiments of the disclosure, the first selection transistor 511, the second selection transistor 513, the third selection transistor 515, the fourth selection transistor 517, the first conductive transistor 531, the second conductive transistor 533, the first discharge transistor 551, the second discharge transistor 552, the first switch transistor 555, the third discharge transistor 554, the second switch transistor 553, and the fourth discharge transistor 556 can be Metal-Oxide-Semiconductor Field-effect Transistors (MOSFETs), which are not specifically limited in the disclosure. The third selection transistor 515, the fourth selection transistor 517, the first conductive transistor 531, the second conductive transistor 533, the third discharge transistor 554, and the fourth discharge transistor 556 may be N-channel MOS field effect transistors. The first selection transistor 511, the second selection transistor 513, the first discharge transistor 551, the second discharge transistor 552, the first switch transistor 555 and the second switch transistor 553 may be P-channel MOS field effect transistors, which is not specifically limited in the disclosure.

In embodiments of the disclosure, for the first selection transistor 511, the second selection transistor 513, the third selection transistor 515, the fourth selection transistor 517, the first discharge transistor 551, the second discharge transistor 552, the third discharge transistor 554, and the fourth discharge transistor 556, the first ends thereof can each be a drain, the second ends thereof can each be a source, and the control ends thereof can each be a gate.

In embodiments of the disclosure, for the first conductive transistor 531, the second conductive transistor 533, the first switch transistor 555, and the second switch transistor 553, the first ends thereof can each be a source, the second ends thereof can each be a drain, and the control ends thereof can each be a gate.

Next, an explanation will be given of a process in which the control unit 50 controls the first light-emitting element A and/or the second light-emitting element B to emit light.

The first light-emitting element A is configured to emit light. When the first signal ab is at the first potential and the second signal sw is at the first potential, the first selection transistor 511 is turned off, and the second selection transistor 513 is turned on. Therefore, the fourth selection transistor 517 is turned off, and the power supply control signal VDD1 is transmitted to the second end from the first end of the second selection transistor 513.

The control end of the third selection transistor 515 and the control end of the first conductive transistor 531 receive the power supply control signal VDD1 from the second end of the second selection transistor 513 and are turned on. Thus, the first cathode voltage of the first power supply ELVSS is transferred to the second end of the first conductive transistor 531.

Since the control end of the fourth discharge transistor 556 receives the second signal sw at the first potential and the fourth discharge transistor 556 is turned on, the first cathode voltage is transferred from the second end of the first conductive transistor 531 to the second end of the fourth discharge transistor 556, and further to the second end of the first light-emitting element A. Further, the first light-emitting element A is configured to emit light.

In addition, the control end of the first discharge transistor 551 receives the first cathode voltage from the second end of the first conductive transistor 531 and is turned on, and then the second cathode voltage of the second power supply ELVDD is transferred to the second end from the first end of the first discharge transistor 551. Since the control end of the third discharge transistor 554 receives the second signal sw which is at the first potential, and the third discharge transistor 554 is turned on, the second cathode voltage is further transferred to the second end of the second light-emitting element B via the third discharge transistor 554. In this case, the second light-emitting element B does not emit light and charges accumulated therein are discharged, thereby avoiding display image sticking and prolonging the service life.

The second light-emitting element B is configured to emit light: when the first signal ab is at the second potential and the second signal sw is at the first potential, the first selection transistor 511 is turned on, and the second selection transistor 513 is turned off. Therefore, the third selection transistor 515 is turned off, and the power supply control signal VDD1 is transmitted from the first end to the second end of the first selection transistor 511.

The control end of the fourth selection transistor 517 and the control end of the second conductive transistor 533 receive the power supply control signal VDD1 from the second end of the first selection transistor 511 and thus are turned on. Thus, the first cathode voltage of the first power supply ELVSS is supplied to the second end of the second conductive transistor 533.

Since the control end of the third discharge transistor 554 receives the second signal sw which is at the first potential and the third discharge transistor 554 is turned on, the first cathode voltage is transferred from the second end of the second conductive transistor 533 to the second end of the third discharge transistor 554 and further to the second end of the second light-emitting element B. In this case, the second light-emitting element B emits light.

In addition, the control end of the second discharge transistor 552 receives the first cathode voltage from the second end of the second conductive transistor 533, and the second discharge transistor 552 is turned on, and then the second cathode voltage of the second power supply ELVDD is transferred to the second end from the first end of the second discharge transistor 552. Since the control end of the fourth discharge transistor 556 receives the second signal sw at the first potential and the fourth discharge transistor 556 is turned on, the second cathode voltage is further transferred to the second end of the first light-emitting element A via the fourth discharge transistor 556. In this case, the first light-emitting element A does not emit light, and charges accumulated therein are discharged, thereby avoiding display image sticking and prolonging the service life.

Both the first light-emitting element A and the second light-emitting element B are configured to emit light: when the second signal sw is at the second potential, the first switch transistor 555 and the second switch transistor 553 are both turned on, the second end of the first switch transistor 555 and the second end of the second switch transistor 553 are both electrically connected to the first power supply ELVSS, and the second end of the first light-emitting element A and the second end of the second light-emitting element B are electrically connected to the first power supply ELVSS. In this case, the first light-emitting element A and the second light-emitting element B emit light at the same time to supplement the luminance of the light-emitting elements, so as to avoid the problem of image sticking or screen burning caused by insufficient luminance, thereby improving the service life of the pixel circuit 40 and improving the display effect of the display panel 10.

Figure 7:
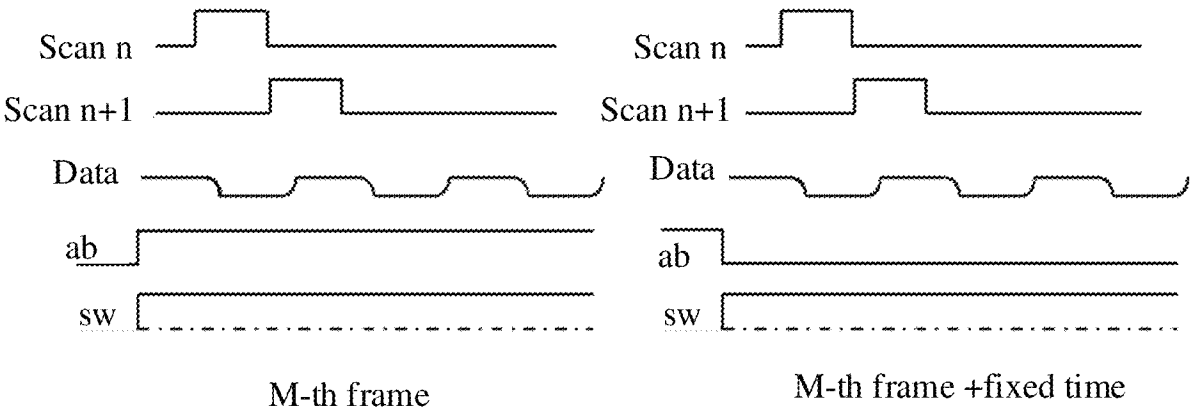
FIG. 7 is an operation timing diagram of the pixel circuit shown in FIG. 5.

Please also refer to FIG. 7, FIG. 7 is an operation timing diagram of the pixel circuit 40 shown in FIG. 5. As shown in FIG. 7, the curves corresponding to Scan n and Scan n+1 respectively correspond to any two adjacent timing in the data line, the curve corresponding to Data is the timing corresponding to the data signal Data, the curve corresponding to ab is the timing corresponding to the first signal ab, and the curve corresponding to sw is the timing corresponding to the second signal sw. The potential switching of the first signal ab corresponds to a preset switching time, that is, the potential of the first signal ab is switched once every time the preset switching time elapses.

In a specific embodiment of the disclosure, the preset switching time may be 200 frames. It should be understood that, the preset switching time may be determined according to a specific condition of the display device 100, which is not specifically limited in the disclosure.

In embodiments of the disclosure, the pixel circuit 40 is provided with a control unit 50, the light-emitting unit 60 is provided with the first light-emitting element A and the second light-emitting element B, and the control unit 50 is configured to selectively control the first light-emitting element A and/or the second light-emitting element B to emit light, so as to prolong the service life of the pixel circuit 40.

On the other hand, the control unit 50 is configured to selectively control the first light-emitting element A or the second light-emitting element B to be electrically connected to the second power supply ELVDD so as to receive the second cathode voltage, thereby releasing the charges accumulated therein when the light-emitting element does not emit light, and further improving the service life of the light-emitting unit 60, reducing the risk of screen burning, and improving the display taste.

Based on the same concept, the disclosure further provides a display panel 10, and the display panel 10 includes several pixel circuits 40 as described above.

Figure 8:
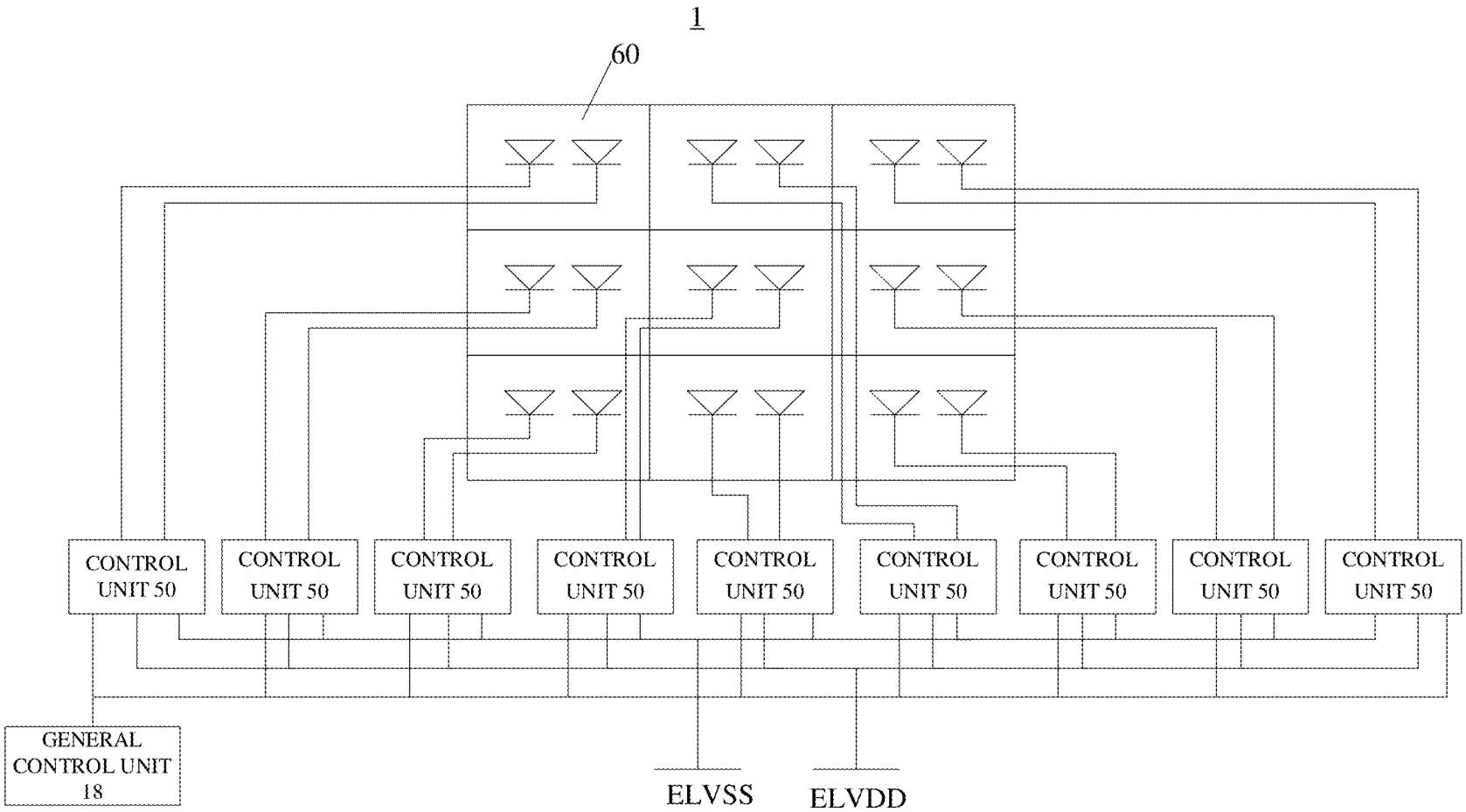
FIG. 8 is a schematic diagram of another display panel disclosed in an embodiment of the disclosure.

Please also refer to FIG. 8, FIG. 8 is a schematic diagram of another display panel 1 according to an embodiment of the disclosure. In embodiments of the disclosure, the difference between the display panel 1 and the display panel 10 lies in that the display panel 1 further includes a general control unit 18. The general control unit 18 is electrically connected to multiple pixel circuits 40, and the general control unit 18 is configured to simultaneously control multiple pixel circuits 40 to switch to the first light-emitting element A and/or the second light-emitting element B to emit light.

As shown in FIG. 8, one display block in the display panel 1 is shown, and the display block includes nine pixel circuits 40. It can be understood that, the pixel circuits 40 in the display panel 1 are controlled in blocks, and the number of the pixel circuits included in each display block may be determined according to actual situations, which is not specifically limited in the disclosure.

In a specific embodiment of the disclosure, communication may be implemented between the general control unit 18 and the pixel circuit 40 by using an Inter-Integrated Circuit bus (IIC), a Serial Peripheral Interface (SPI), and so on, and how to select a protocol may be determined according to actual situations, which is not specifically limited in the disclosure.

It should be noted that, in embodiments of the disclosure, the display panel 10 includes multiple pixel circuits 40, each of the pixel circuits 40 includes one control unit 50, each control unit 50 corresponds to one address, and the general control unit 18 is configured to send control signals to the multiple control units 50. The control signal includes a start segment, multiple address segments, and multiple instruction segments, where the start segment includes a 0.5 milliseconds (ms) start signal at a first potential. Each address segment is a 4 microsecond (us) data signal containing a block address, and each instruction segment is a 2 us data signal containing instruction information.

In other words, the control signal includes a start part and several data parts, the start part does not include data information, and each data part includes data of six bytes (bits), where the first four bits are addresses of corresponding display blocks, and the last two bits are corresponding signal instructions. The signal instruction corresponds to the second signal sw and the first signal ab.

In embodiments, the display blocks controlled by the general control unit 18 receive the control signal, and the address segment of the control signal identifies the corresponding control unit and then continues to output the instruction segment of the control signal, so as to control the pixel circuit 40 to switch the light-emitting element for emitting light. It can be understood that the pixel circuit 40 which does not correspond to the address segment of the control signal continues to emit light with the light emitting element originally configured to emit light.

In embodiments of the disclosure, 1 bit corresponds to 1 us, which is not specifically limited in the disclosure, and the length of the signal included in the control signal can be determined according to actual situations.

Figure 9:
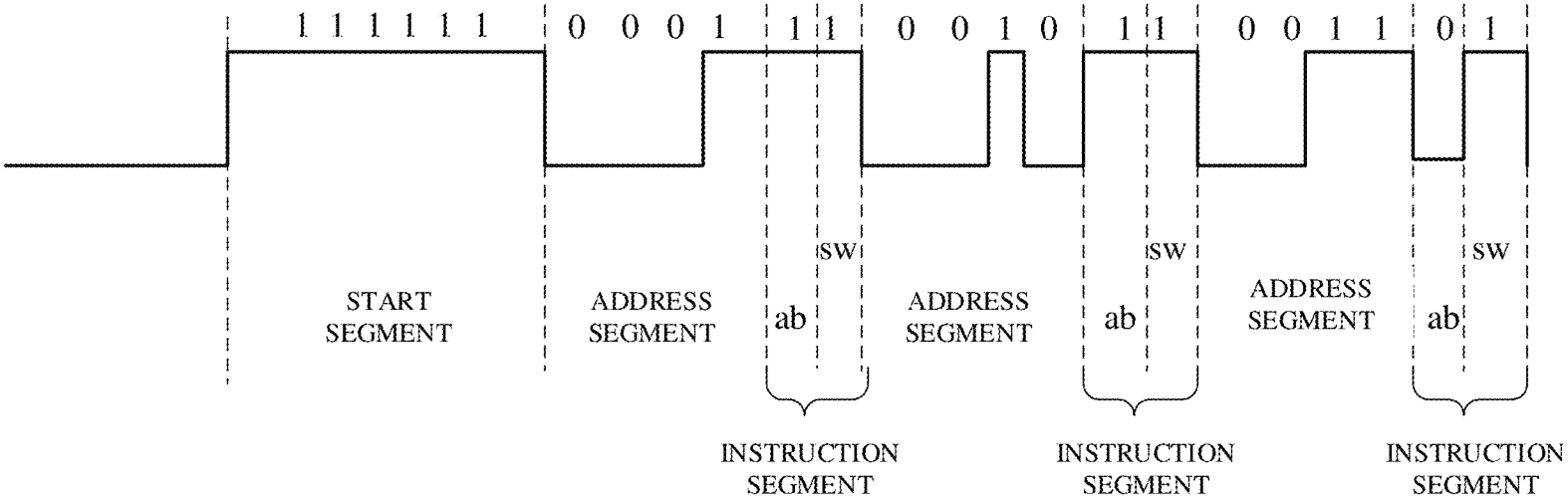
FIG. 9 is a timing diagram of control signals sent by a general control unit in the display panel shown in FIG. 8.

Please refer to FIGS. 9 and 10 together, FIG. 9 is a timing diagram of the control signal sent by the general control unit 18 in the display panel 1 shown in FIG. 8. FIG. 10 shows addresses corresponding to each control unit in the display panel 1 shown in FIG. 8.

As shown in FIG. 9, a timing diagram of a control signal sent by the general control unit 18 is shown, where a start segment of the control signal is "111111", and a first address segment is 0001. The first instruction segment is 11, where the first 1 of the first instruction segment corresponds to the first signal ab at the first potential, and the second 1 of the first instruction segment corresponds to the second signal sw at the first potential. The second address segment is 0010, and the second instruction segment is also 11, where the first 1 of the second instruction segment corresponds to the first signal ab at the first potential, and the second 1 of the second instruction segment corresponds to the second signal sw at the first potential. The third address segment is 0011, and the third instruction segment is 01, where 0 of the third instruction segment corresponds to the first signal ab at the second potential, and 1 corresponds to the second signal sw at the first potential.

Different control units 50 correspondingly receive or not receive the instruction segment according to the address segment of the control signal received. Specifically, the general control unit 18 sends the instruction signal corresponding to the address segment to the control unit 50 corresponding to the address segment, so as to control the pixel circuit 40 to switch the light-emitting element for emitting light.

As shown in FIG. 10, the control units 50 of nine pixel circuits 40 shown in FIG. 8 are sequentially marked as control unit 1, and control unit 2 to control unit 9, and addresses corresponding to the nine control units 50 are shown in the figure.

Next, the embodiments are described with reference to an example in which each block includes nine pixel circuits.

In embodiments of the disclosure, the general control unit 18 is electrically connected to the control units 50 of the nine pixel circuits 40. In this case, when display abnormality occurs in two or more pixel circuits 40 in the display block, the total control unit 18 may control the two or more pixel circuits 40 to switch the light-emitting element of the light-emitting unit 60 to emit light. It can be understood that the display abnormality refers to phenomena such as screen burning and image sticking.

In order to clearly illustrate that the general control unit simultaneously controls two pixel circuits 40 to switch the light-emitting element, two of the pixel circuits in the display area block are denoted as a first pixel circuit and a second pixel circuit.

For example, in an implementation of the disclosure, when the first light-emitting element A of the first pixel circuit is abnormal and the second light-emitting element B of the second pixel circuit is abnormal, the general control unit 18 controls the first pixel circuit and the second pixel circuit to switch to the other light-emitting element simultaneously to display a picture. That is, the first pixel circuit is switched to the second light-emitting element B for display, and the second pixel circuit is switched to the first light-emitting element A for display. It can be understood that the total control unit 18 may also control three, four or other number of pixel circuits 40 to switch the light emitting elements at the same time, which is not specifically limited in the disclosure.

Based on the same concept, the disclosure further provides a display device 100, which includes the described display panel.

In the pixel circuit 40, the display panel, and the display device 100 of the disclosure, the pixel circuit 40 is provided with the control unit 50, the light-emitting unit 60 is provided with the first light-emitting element A and the second light-emitting element B, and the control unit 50 selectively controls the first light-emitting element A and/or the second light-emitting element B to emit light, so as to improve the service life of the pixel circuit 40. At the same time, the control unit 50 selectively controls the first light-emitting element A or the second light-emitting element B to be electrically connected to the second power supply ELVDD so as to receive the second cathode voltage, thereby releasing charges accumulated therein when not emit light, and further improving the service life of the light-emitting unit 60, reducing the risk of screen burning, and improving the display taste.

In addition, the display panel is provided with the general control unit 18, so as to perform block based control on several pixel circuits 40 in the display panel. The general control unit 18 is arranged in each display block, and the general control unit 18 is configured to switch a light-emitting element used for display for an abnormal pixel circuit 40, thereby further improving the efficiency of controlling the display effect.

In summary, in the pixel circuit, the display panel, and the display device of the disclosure, the pixel circuit is provided with the control unit, the light-emitting unit including the first light-emitting element and the second light-emitting element, and the control unit selectively controls the first light-emitting element and/or the second light-emitting element to emit light, so as to improve the service life of the pixel circuit. At the same time, the control unit selectively controls the second end of the first light-emitting element or the second end of the second light-emitting element to be electrically connected to the second power supply to receive the second cathode voltage, so as to release charges accumulated therein when the first light-emitting element or the second light-emitting element does not emit light, thereby further prolonging the service life of the light-emitting unit, reducing the risk of screen burning, and improving the display taste.

In addition, the general control unit is arranged in the display panel, so as to perform block-based control on multiple pixel circuits in the display panel. The general control unit is arranged in each display block, and the general control unit is configured to control switch pixel circuits having a display abnormality to switch light-emitting elements used for display, thereby further improving the efficiency of display effect control.

All possible combinations of the technical features in the above embodiments are described, however, any combination of these technical features should be considered as within the scope of the disclosure without conflict.

Reference throughout this description to "an embodiment," "some embodiments," 'an illustrative embodiment," "an example," "a specific example," or "some examples," means that a particular feature, structure, material, or characteristic described in connection with the embodiment or example is included in at least one embodiment or example of the disclosure. Thus, schematic expressions of the above terms may not necessarily refer to the same implementation or example of the disclosure. Furthermore, the particular features, structures, materials, or characteristics may be combined in any suitable manner in one or more embodiments or examples.

What is claimed is:

1. A pixel circuit, comprising a light-emitting unit and a drive unit, the pixel circuit further comprising a control unit, wherein the light-emitting unit comprises a first light-emitting element and a second light-emitting element, and the first light-emitting element and the second light-emitting element are both electrically connected to the drive unit; the drive unit is configured to transmit to the light-emitting unit a data signal for driving the first light-emitting element and/or the second light-emitting element to emit light, wherein the control unit comprises a conduction selection unit, a conduction control unit, and a switch unit, the conduction control unit is electrically connected to both the conduction selection unit and the switch unit, and the switch unit is electrically connected to the first light-emitting element and the second light-emitting element;

the conduction selection unit comprises a first selection transistor, a second selection transistor, a third selection transistor, and a fourth selection transistor, the first selection transistor is configured to receive a first signal and a power supply control signal, the first selection transistor is electrically connected to the third selection transistor and the conduction control unit, the second selection transistor is configured to receive an inverted signal of the first signal and the power supply control signal, the second selection transistor is electrically connected to the fourth selection transistor and the conduction control unit, the third selection transistor and the fourth selection transistor are electrically connected to a first power supply, and the conduction selection unit is configured to selectively control the conduction control unit to be in a first conductive state or a second conductive state according to the first signal received;

the light-emitting unit is configured to receive the data signal, the switch unit is configured to receive a second signal and control, according to a conductive state of the conduction selection unit and a potential of the second signal, the first light-emitting element and/or the second light-emitting element to be electrically connected to the first power supply, to cause the first light-emitting element and/or the second light-emitting element to emit light;

the switch unit is further configured to control, according to the conductive state of the conduction selection unit and the potential of the second signal, the first light-emitting element and/or the second light-emitting element to be electrically connected to a second power supply, to discharge charges accumulated in the first light-emitting element and/or the second light-emitting element.

2. The pixel circuit of claim 1, wherein the drive unit comprises a first transistor, a second transistor, and a storage capacitor, one end of the storage capacitor is electrically connected to a second end of the first transistor, and another end of the storage capacitor is electrically connected to a first end of the second transistor; a control end of the first transistor is configured to receive a scan signal, a first end of the first transistor is configured to receive the data signal, and a second end of the first transistor is electrically connected to a control end of the second transistor;

a first end of the second transistor is configured to receive a power supply signal, and a second end of the second transistor is electrically connected to the light-emitting unit;

the first transistor is configured to selectively transmit the data signal to the second transistor according to a potential of the scan signal received, and the second transistor is configured to selectively transmit the power supply signal to the light-emitting unit according to the data signal received.

3. The pixel circuit of claim 2, wherein when the scan signal received by the first transistor is at a first potential, the first end of the first transistor and the second end of the first transistor are electrically disconnected; when the scan signal received by the first transistor is at a second potential, the first end of the first transistor and the second end of the first transistor are electrically conducted, and the data signal is transmitted to the second transistor;

when the data signal received by the second transistor is at the first potential, the first end of the second transistor and the second end of the second transistor are electrically disconnected; when the data signal received by the second transistor is at the second potential, the first end of the second transistor and the second end of the second transistor are electrically conducted, and the power supply signal is transmitted to the light-emitting unit.

4. The pixel circuit of claim 2, wherein a first end of the first light-emitting element and a first end of the second light-emitting element are electrically connected to the second end of the second transistor, and both a second end of the first light-emitting element and a second end of the second light-emitting element are electrically connected to the control unit;

the control unit is configured to receive the first signal and the second signal, and controls, according to the potentials of the first signal and the second signal, the second end of the first light-emitting element and/or the second end of the second light-emitting element to be electrically connected to the first power supply.

5. The pixel circuit of claim 1, wherein when the first signal received by the control unit is at a first potential and the second signal is at the first potential, the second end of the first light-emitting element is electrically connected to the first power supply, and is configured to receive a first cathode voltage from the first power supply, wherein the first light-emitting element is configured to emit light, and the second end of the second light-emitting element is electrically connected to the second power supply and configured to receive a second cathode voltage from the second power supply;

when the first signal received by the control unit is at a second potential and the second signal is at the first potential, the second end of the second light-emitting element is electrically connected to the first power supply, and is configured to receive the first cathode voltage from the first power supply, the second light-emitting element is configured to emit light, and the second end of the first light-emitting element is electrically connected to the second power supply and configured to receive the second cathode voltage from the second power supply;

when the second signal received by the control unit is at the second potential, the second end of the first light-emitting element and the second end of the second light-emitting element are both electrically connected to the first power supply and configured to receive the first cathode voltage from the first power supply, and the first light-emitting element and the second light-emitting element are both configured to emit light.

6. The pixel circuit of claim 1, wherein when the first signal is at a first potential, the inverted signal is at a second potential, the first selection transistor and the fourth selection transistor are turned off, the second selection transistor and the third selection transistor are turned on, and the power-supply control signal is transmitted from the second end of the second selection transistor to the conduction control unit;

when the first signal is at the second potential, the inverted signal is at the first potential, the second selection transistor and the third selection transistor are turned off, the first selection transistor and the fourth selection transistor are turned on, and the power-supply control signal is transmitted from the second end of the first selection transistor to the conduction control unit.

7. The pixel circuit of claim 1, wherein the conduction control unit comprises a first conductive transistor and a second conductive transistor, a control end of the first conductive transistor is electrically connected to the second end of the second selection transistor, a control end of the second conductive transistor is electrically connected to the second end of the first selection transistor, a first end of the first conductive transistor and a first end of the second conductive transistor are electrically connected to the first power supply, a second end of the first conductive transistor and a second end of the second conductive transistor are electrically connected to the switch unit;

when the first conductive transistor receives the power-supply control signal from the second selection transistor, the first conductive transistor is turned on, the second conductive transistor is turned off, and the conduction control unit is in the first conductive state; when the second conductive transistor receives the power-supply control signal from the first selection transistor, the first conductive transistor is turned off, the second conductive transistor is turned on, and the conduction control unit is in the second conductive state.

8. The pixel circuit of claim 7, wherein the switch unit comprises a first discharge transistor, a second discharge transistor, a third discharge transistor, and a fourth discharge transistor, a control end of the first discharge transistor is electrically connected to the second end of the first conductive transistor, a control end of the second discharge transistor is electrically connected to the second end of the second conductive transistor, a first end of the first discharge transistor and a first end of the second discharge transistor are electrically connected to the second power supply, a second end of the first discharge transistor is electrically connected to a second end of the second conductive transistor, a second end of the second discharge transistor is electrically connected to the second end of the first conductive transistor;

a control end of the third discharge transistor is configured to receive the second signal; a first end of the third discharge transistor is electrically connected to a second end of the second conductive transistor and a second end of the first discharge transistor; a second end of the third discharge transistor is electrically connected to the second end of the second light-emitting element;

a control end of the fourth discharge transistor is configured to receive the second signal; a first end of the fourth discharge transistor is electrically connected to a second end of the first conductive transistor and a second end of the second discharge transistor; and a second end of the fourth discharge transistor is electrically connected to a second end of the first light-emitting element.

9. The pixel circuit of claim 8, wherein when the conduction control unit is in the first conductive state and the second signal is at a first potential, the first discharge transistor, the third discharge transistor, and the fourth discharge transistor are turned on, the second discharge transistor is turned off, and a first cathode voltage of the first power supply is transferred to the second end of the first light-emitting element, the first light-emitting element is configured to emit light, and a second cathode voltage of the second power supply is transferred to the second end of the second light-emitting element;

when the conduction control unit is in the second conductive state and the second signal is at the first potential, the second discharge transistor, the third discharge transistor, and the fourth discharge transistor are turned on, the first discharge transistor is turned off, and a first cathode voltage of the first power supply is transferred to the second end of the second light-emitting element, the second light-emitting element is configured to emit light, and a second cathode voltage of the second power supply is transferred to the second end of the first light-emitting element.

10. The pixel circuit of claim 9, wherein the switch unit further comprises a first switch transistor and a second switch transistor, a control end of the first switch transistor and a control end of the second switch transistor are configured to receive the second signal, a first end of the first switch transistor and a first end of the second switch transistor are electrically connected to the first power supply, a second end of the first switch transistor is electrically connected to the second end of the first light-emitting element, a second end of the second switch transistor is electrically connected to the second end of the second light-emitting element;

when the second signal is at the second potential, both the first switch transistor and the second switch transistor are in turned on, and the first cathode voltage of the first power supply is transferred to the second end of the first light-emitting element and the second end of the second light-emitting element.

11. A display panel, comprising a plurality of pixel circuits, wherein the plurality of pixel circuits each comprises:

a light-emitting unit and a drive unit, the pixel circuit further comprising a control unit, wherein the light-emitting unit comprises a first light-emitting element and a second light-emitting element, and the first light-emitting element and the second light-emitting element are both electrically connected to the drive unit; the drive unit is configured to transmit to the light-emitting unit a data signal for driving the first light-emitting element and/or the second light-emitting element to emit light, wherein the control unit comprises a conduction selection unit, a conduction control unit, and a switch unit, the conduction control unit is electrically connected to both the conduction selection unit and the switch unit, and the switch unit is electrically connected to the first light-emitting element and the second light-emitting element;

the conduction selection unit comprises a first selection transistor, a second selection transistor, a third selection transistor, and a fourth selection transistor, the first selection transistor is configured to receive a first signal and a power supply control signal, the first selection transistor is electrically connected to the third selection transistor and the conduction control unit, the second selection transistor is configured to receive an inverted signal of the first signal and the power supply control signal, the second selection transistor is electrically connected to the fourth selection transistor and the conduction control unit, the third selection transistor and the fourth selection transistor are electrically connected to a first power supply, and the conduction selection unit is configured to selectively control the conduction control unit to be in a first conductive state or a second conductive state according to the first signal received;

the light-emitting unit is configured to receive the data signal, the switch unit is configured to receive a second signal and control, according to a conductive state of the conduction selection unit and a potential of the second signal, the first light-emitting element and/or the second light-emitting element to be electrically connected to the first power supply, to cause the first light-emitting element and/or the second light-emitting element to emit light; the switch unit is further configured to control, according to the conductive state of the conduction selection unit and the potential of the second signal, the first light-emitting element and/or the second light-emitting element to be electrically connected to a second power supply, to discharge charges accumulated in the first light-emitting element and/or the second light-emitting element.

12. A display device, comprising a display panel, the display panel comprising a plurality of pixel circuits, wherein the plurality of pixel circuits each comprises:

a light-emitting unit and a drive unit, the pixel circuit further comprising a control unit, wherein the light-emitting unit comprises a first light-emitting element and a second light-emitting element, and the first light-emitting element and the second light-emitting element are both electrically connected to the drive unit; the drive unit is configured to transmit to the light-emitting unit a data signal for driving the first light-emitting element and/or the second light-emitting element to emit light, wherein the control unit comprises a conduction selection unit, a conduction control unit, and a switch unit, the conduction control unit is electrically connected to both the conduction selection unit and the switch unit, and the switch unit is electrically connected to the first light-emitting element and the second light-emitting element;

the conduction selection unit comprises a first selection transistor, a second selection transistor, a third selection transistor, and a fourth selection transistor, the first selection transistor is configured to receive a first signal and a power supply control signal, the first selection transistor is electrically connected to the third selection transistor and the conduction control unit, the second selection transistor is configured to receive an inverted signal of the first signal and the power supply control signal, the second selection transistor is electrically connected to the fourth selection transistor and the conduction control unit, the third selection transistor and the fourth selection transistor are electrically connected to a first power supply, and the conduction selection unit is configured to selectively control the conduction control unit to be in a first conductive state or a second conductive state according to the first signal received;

the light-emitting unit is configured to receive the data signal, the switch unit is configured to receive a second signal and control, according to a conductive state of the conduction selection unit and a potential of the second signal, the first light-emitting element and/or the second light-emitting element to be electrically connected to the first power supply, to cause the first light-emitting element and/or the second light-emitting element to emit light; the switch unit is further configured to control, according to the conductive state of the conduction selection unit and the potential of the second signal, the first light-emitting element and/or the second light-emitting element to be electrically connected to a second power supply, to discharge charges accumulated in the first light-emitting element and/or the second light-emitting element.

* * * * *